US010591267B2

(12) United States Patent
Sorensen et al.

(10) Patent No.: US 10,591,267 B2
(45) Date of Patent: Mar. 17, 2020

(54) PROJECTILE

(71) Applicant: U.S. Army Research Laboratory, Adelphi, MD (US)

(72) Inventors: Brett R. Sorensen, Bel Air, MD (US); Christopher S. Meyer, North East, MD (US); Richard L. Summers, Conowingo, MD (US); Jason C. Angel, Bel Air, MD (US); Timothy G. Farrand, Forest Hill, MD (US); Daniel R. Scheffler, Belcamp, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/720,028

(22) Filed: Sep. 29, 2017

(65) Prior Publication Data

US 2018/0195845 A1 Jul. 12, 2018

Related U.S. Application Data

(60) Provisional application No. 62/445,032, filed on Jan. 11, 2017.

(51) Int. Cl.
*F42B 12/60* (2006.01)
*F42B 12/34* (2006.01)
*F42B 12/66* (2006.01)

(52) U.S. Cl.
CPC ..... *F42B 12/60* (2013.01); *F42B 12/34* (2013.01); *F42B 12/66* (2013.01)

(58) Field of Classification Search
CPC ..... F42B 12/204; F42B 12/30; F42B 12/34; F42B 12/60; F42B 12/66; F42B 12/68; F41H 13/00; F41H 13/0006
USPC ..... 102/474, 517
See application file for complete search history.

(56) References Cited

U.S. PATENT DOCUMENTS 1,312,764 A * 8/1919 Straub ..... F42B 12/66 102/504
1,536,164 A * 5/1925 Tainton ..... F42B 12/66 102/504
2,372,383 A * 3/1945 Lee ..... F41H 11/04 102/504
5,561,263 A * 10/1996 Baillod ..... F41H 13/0006 102/483
6,626,077 B1 * 9/2003 Gilbert ..... F41H 13/0006 102/400
7,284,490 B1 10/2007 Mustacio
8,141,493 B1 * 3/2012 Kuchman ..... F41H 13/0006 102/439
2005/0016372 A1 * 1/2005 Kilvert ..... F41H 13/0006 89/1.34

FOREIGN PATENT DOCUMENTS

FR 491906 A * 6/1919 ..... F42B 12/66

* cited by examiner

*Primary Examiner* — James S Bergin
(74) *Attorney, Agent, or Firm* — Christos S. Kyriakou

(57) ABSTRACT

A cannon projectile having an elongated body with a plurality of elongated and circumferentially spaced segments. At least one tether is attached to at least one end of the segments to hold the segments together. A deployment device, when activated, enables the segments to deploy radially outwardly into a pattern controlled at least in part by the at least one tether using aerodynamic and inertial forces only.

23 Claims, 5 Drawing Sheets

PROJECTILE

CROSS-REFERENCE TO RELATED APPLICATIONS

This application claims priority to and the benefit of U.S. Provisional Application No. 62/445,032, titled "Projectile" filed on Jan. 11, 2017 which is hereby incorporated by reference herein.

GOVERNMENT INTEREST

The invention described herein may be manufactured, used, and licensed by or for the United States Government.

BACKGROUND OF THE INVENTION

I. Field of the Invention

The present invention relates to projectiles and, more particularly, to projectiles that are launched by cannons and similar artillery.

II. Description of Related Art

There are many different kinds of previously known projectiles of the type that are launched by cannons, e.g. from a tank. These projectiles often include explosive warheads, which explode upon contact with the target. Still other types of projectiles include kinetic energy projectiles, which are designed to penetrate certain types of targets. Such kinetic energy projectiles are typically launched from a cannon by means of a discarding sabot, which facilitates the launch of the projectile, but does not contribute to the terminal effects of the projectile.

In certain situations it is desirable to create a man-sized opening in a concrete wall or similar structure to enable warfighters to enter the structure through the opening. These previously known projectiles, however, have proven unable to adequately and consistently create man-sized openings in concrete walls, including reinforced concrete walls and similar structures, with a single event.

SUMMARY OF THE PRESENT INVENTION

The present invention relates to a projectile launched by a cannon, which in preferred embodiments overcomes many of the previously known disadvantages of the previously known projectiles.

In brief, the projectile of the present invention comprises an elongated body, which is launched by a cannon, such as a tank cannon or similar weapon. The elongated body includes a plurality of elongated and circumferentially spaced segments, which form the bulk of the body. These segments, furthermore, are preferably substantially identical to each other.

At least one tether is attached to at least one end of the segments to attach the segments together. The tether may be attached to the rear ends of the segments, front and rear ends of the segments, as well as other combinations.

A deployment device and a projectile, when activated, enables the segments to deploy radially outwardly from each other into a pattern controlled at least in part by the tether. For example, the tether may be attached to the rear ends of the segments so that, when deployed, the segments form a radial spoke pattern in which the spokes are substantially equidistantly spaced from each other. Similarly, the tether may attach adjacent segments to each other so that, when deployed, the segments form a continuous loop of essentially the same size desired to be formed in the target.

The segments are constructed of a hard material, such as steel, tungsten, or the like. When the segments deployed in their pattern impact upon the target, the controlled shape of the pattern is sufficient to form man-sized openings in concrete walls and similar structures.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
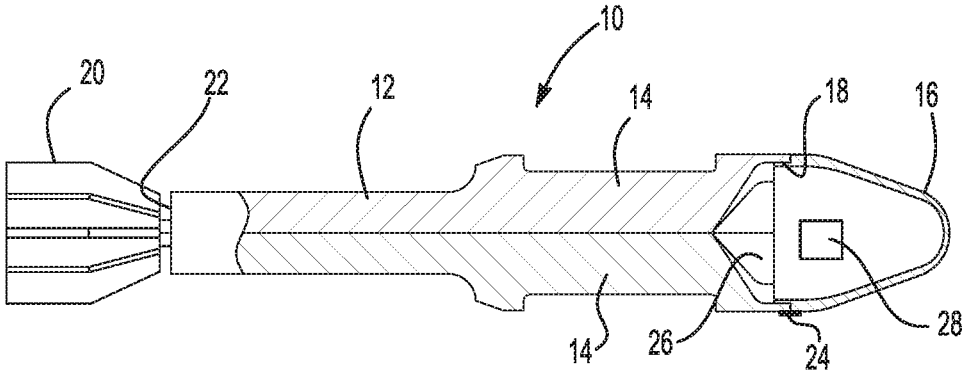
FIG. 1 is a longitudinal sectional view illustrating a preferred embodiment of the projectile of the present invention.
Figure 2:
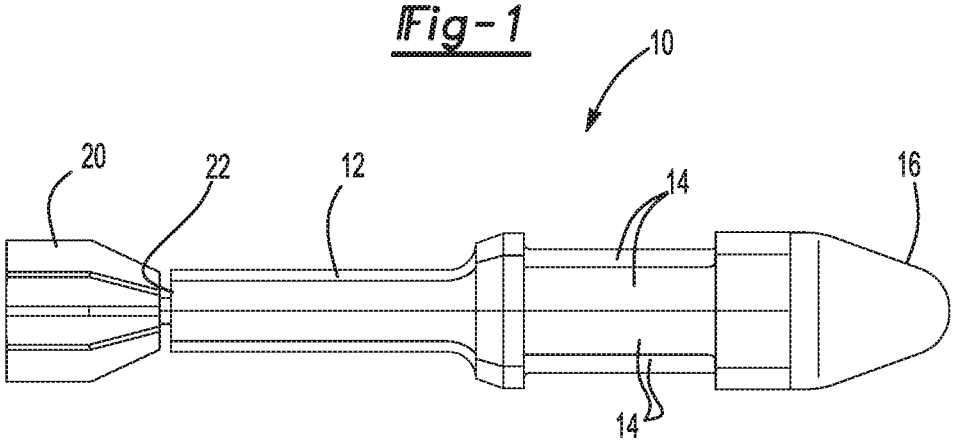
FIG. 2 is a side view thereof.
Figure 3:
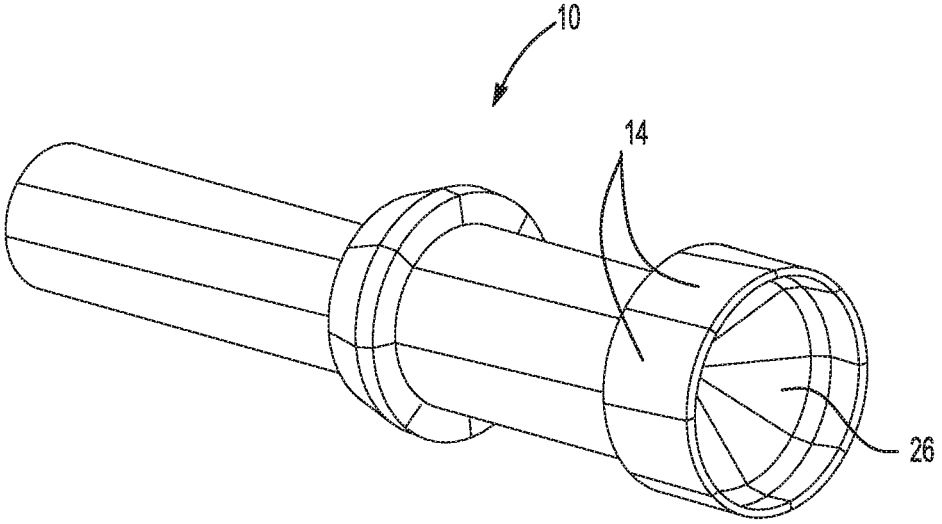
FIG. 3 is an elevational view of the projectile, but with parts removed for clarity.

With reference first to FIGS. 1-3, a first preferred embodiment of the projectile 10 according to the present invention is shown. The projectile 10 is of the type adapted to be launched by a cannon, such as a tank or similar military weapon.

The projectile 10 includes an elongated body 12 formed from a plurality of elongated segments 14. These segments 14 are positioned circumferentially adjacent each other and are preferentially substantially identical to each other. The projectile body 12 illustrated in FIGS. 1-3 includes eight segments 14. More or fewer segments 14 may be utilized without deviation from the spirit or scope of the invention.

A windshield 16, such as a nose cone, is positioned across a front end 18 of the segments 14. Similarly, a tail fin assembly 20 is attached to a rear end 22 of the body 12. The windshield 16 and tail fin assembly 20 together aerodynamically streamline the projectile 10 thereby improving the overall accuracy of the projectile 10 while reducing its aerodynamic drag. The tail fin assembly 20 and windshield 16 may be constructed of any suitable material provided that it is capable of withstanding the launch forces on the projectile 10.

In addition to improving the aerodynamic characteristics of the projectile, the windshield 16 also serves to hold the segments 14 together until the windshield 16 is discarded or otherwise separated from the projectile body 12. Any conventional mechanism may be used by the windshield 16 to hold the segments 14 together, such as an outer retaining lip 24 on the windshield 16, which engages an annular recess at the front end 18 of the segments 14.

Referring now particularly to FIGS. 1 and 3, each segment 14 includes an aerodynamic reaction surface 26 at its front end. This surface 26, furthermore, is covered by the windshield 16 during the launch and until the windshield 16 separates from the body 12. Upon separation, the aerodynamic surface 26, which is in the shape of a forward facing recess, so that with the windshield 16 removed, the aerodynamic force against the reaction surface 26 during flight, causes the segments to separate radially outwardly from each other.

As shown in FIG. 1, a deployment device 28 is contained within the windshield 16. This deployment device 28 separates the windshield 16 from the projectile body 12 at a predetermined distance, e.g. several meters, prior to impact. Any conventional means may be used by the deployment device 28 to separate the windshield 16 from the body 12 at the desired time. For example, the deployment device 28 may contain a processor that is programmed to separate the windshield 16 at a predetermined time after launch. This program, furthermore, would be adjusted by the programmer to compensate for different distances between the launch cannon and the target. Similarly, the deployment device 28 may include a rangefinder which detects the range between the projectile 10 and the target and deploys the segments 14 radially outwardly at a predetermined distance prior to impact. Other means to deploy the segments 14 radially outwardly at the desired distance from the target may alternatively be used without deviation from the spirit or scope of the invention.

Figure 4A:
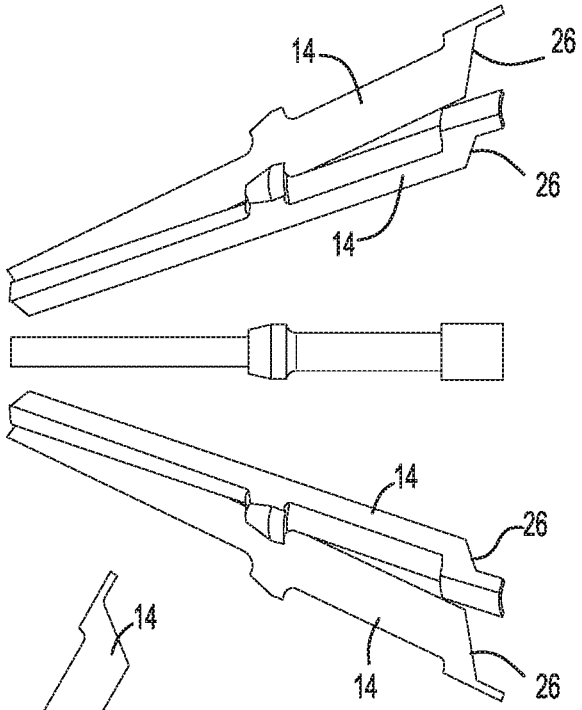
FIGS. 4A and 4B are side views illustrating one possible pattern of the segments during deployment at two discrete points in time.

With reference now to FIG. 4A, FIG. 4A shows the position of the segments 14 a short time after activation of the deployment device 28 (FIG. 1). As can be seen in FIG. 4A, the segments 14 expand radially outwardly due to the reaction between the aerodynamic reaction surface 26 and the airflow impacting upon the aerodynamic reaction surface 26.

Figure 4B:
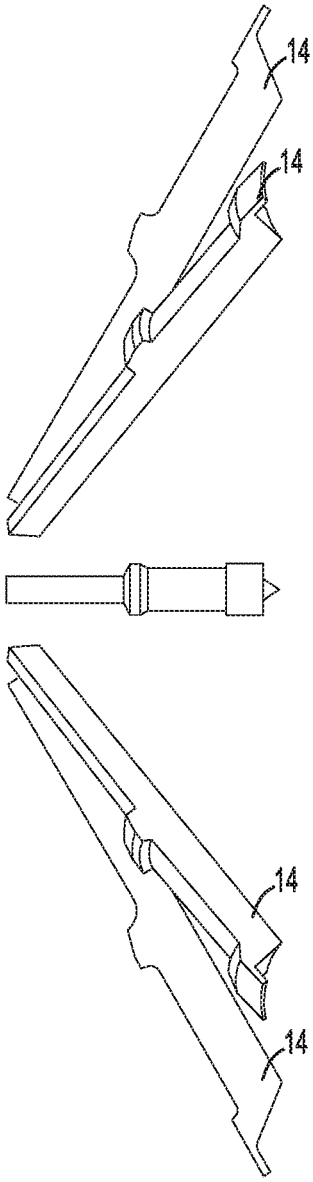

FIG. 4B illustrates the position of the segments 14 at a short period of time after the position shown in FIG. 4A. As can be seen in FIG. 4B, the segments 14 continue to expand radially outwardly from their initial position, shown in FIG. 4A, in which the segments 14 collapse against each other to form the substance of the projectile body 12.

Figure 5:
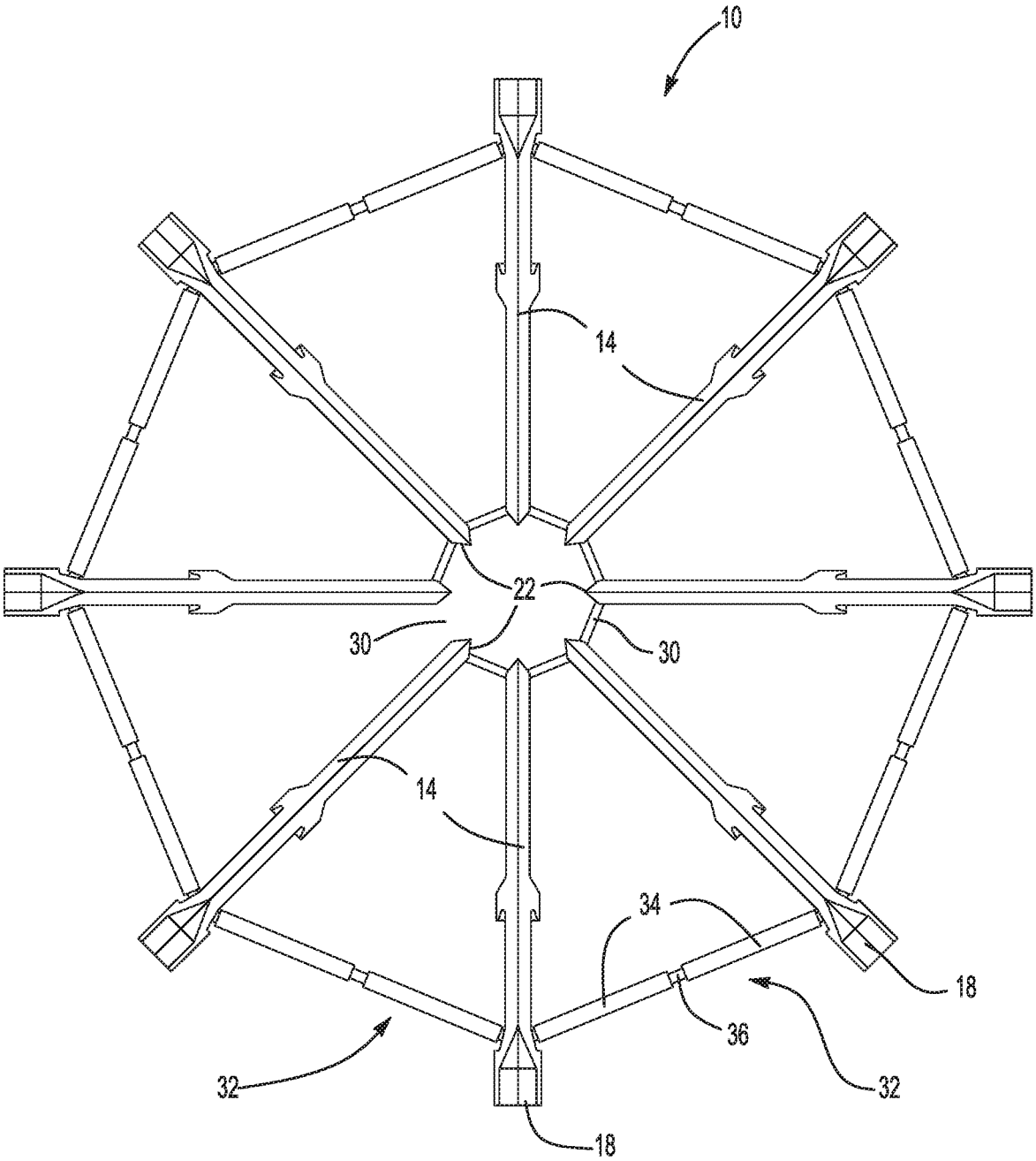
FIG. 5 is a front view illustrating the segments upon full deployment of another possible configuration, but illustrating the presence of tethers and possibly high-density bars.

With reference now to FIG. 5, the projectile 10 is there shown with the segments 14 in a fully deployed position and ready for impact against the target. In order to maintain the configuration or pattern of the segments 14 so that the segments 14 are not only properly spaced from each other, but also impact the target at substantially the same time, a tether 30 is connected to the rear end 22 of each of the segments 14. The tether 30 aids in the deployment of the segments 14 by redirecting linear momentum from aerodynamic reaction into angular movement and also holds the segments 14 in a radial spoke pattern.

In order to further maintain the stability of the radial spoke pattern following deployment of the segments 14, a constraint 32 optionally extends between the front ends 18, now the outer ends of the pattern, of the segments 14.

The tether 30 may be constructed from any appropriate material, such as steel cable, high strength synthetic material, or the like. Similarly, the constraints 32 may also be constructed of a similar material or, alternatively, constructed from a pair of rigid cylindrical sections 34 which are pivotally connected together by a pivot 36 and pivotally connected to adjacent segments 14. The use of rigid cylindrical rods 34 for the constraint 32 provides further stability for the overall structure of the pattern of the segments 14 following deployment. These rods 34 can be made of a high-density material, e.g. tungsten, to further contribute to the defeat of the target.

Figure 6:
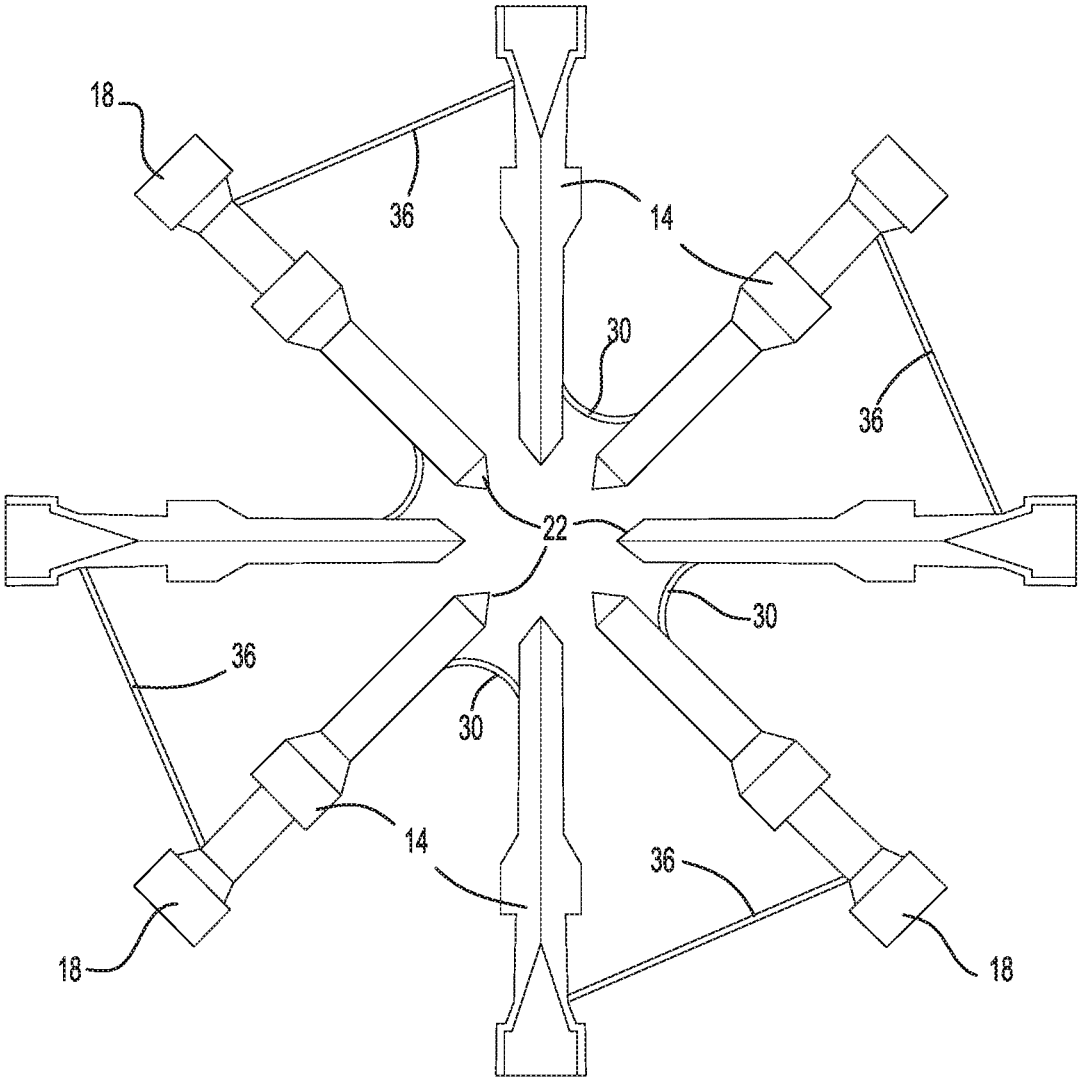
FIG. 6 is a view similar to FIG. 5, but illustrating a modification of the tether configuration.
Figure 7:
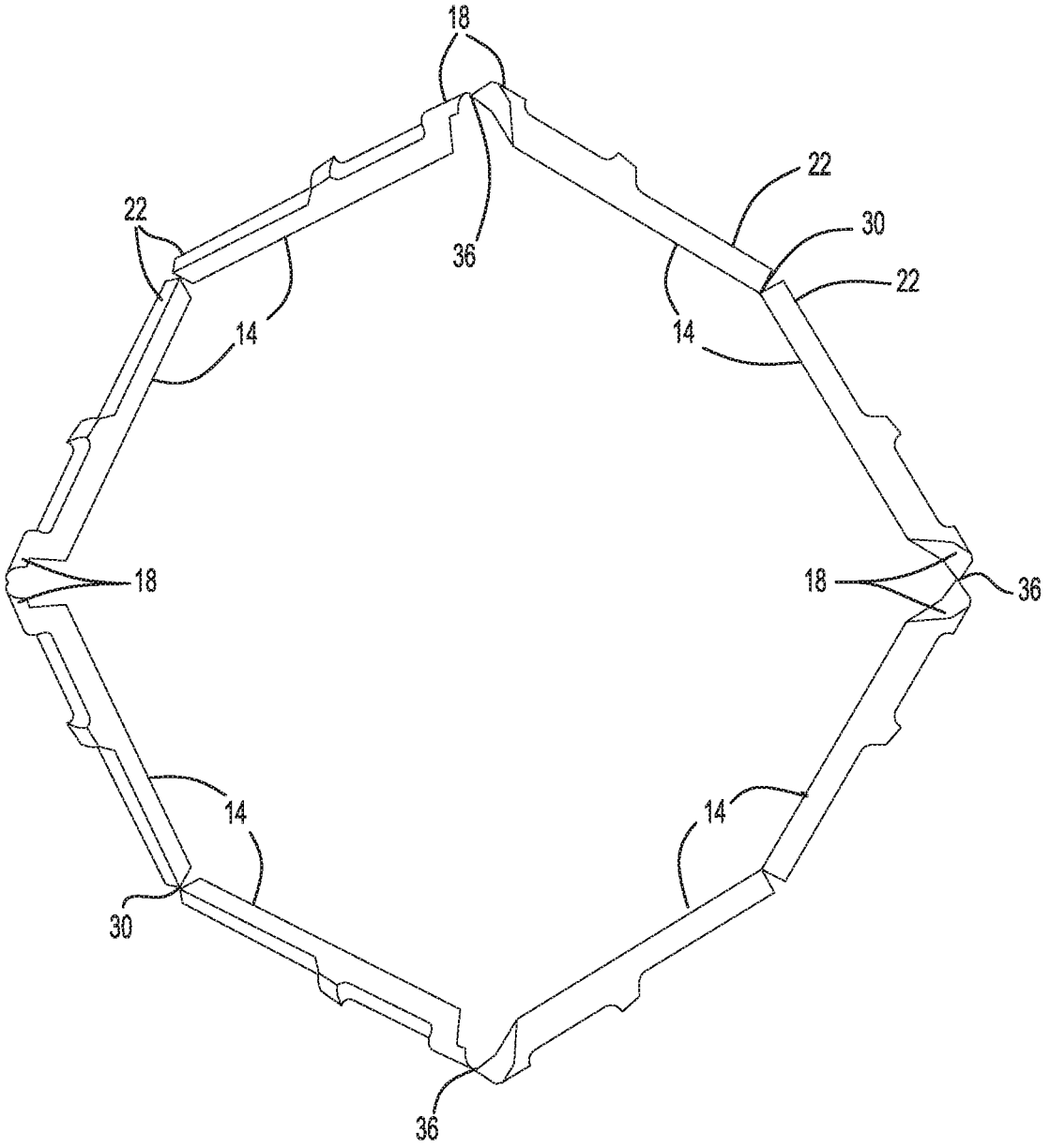
FIG. 7 is a view displaying the final deployed configuration resulting from the tether configuration illustrated in FIG. 6, a still further modification thereof.

With reference now to FIG. 6, a still further construction for the tether 30 is shown in which the tether 30 alternately extends between the adjacent rear ends 22 of the segments 14 and similarly for tether 36 adjacent front ends 18 of the segments 14. FIG. 7 shows yet a further pattern for the segments 14 following deployment in which the front and rear ends 18 and 22 of the segments 14 are secured together by aft and fore tethers 30 and 36 so that, following deployment, the segments 14 form a continuous loop.

For maximum efficiency, the segments 14 are constructed of a hard, dense material, such as high strength steel. Alternatively, an even denser material, such as tungsten, may be used encased in a lighter material, such as plastic. Such a denser material provides greater kinetic energy to the target on impact.

From the foregoing, it can be seen that the present invention provides a novel projectile for a cannon, such as a tank cannon or artillery cannon, which is capable of forming a man-sized opening through a concrete wall or similar structure. Having described our invention, however, many modifications thereto will become apparent to those skilled in the art to which it pertains without deviation from the spirit of the invention as defined by the scope of the appended claims.

We claim:

1. A projectile comprising:

an elongated body, said body comprising a plurality of elongated and circumferentially spaced segments, wherein each segment has a front end and a rear end and wherein each front end comprises a forward facing aerodynamic reaction surface which, when exposed during flight of the projectile, causes said segments to radially separate from each other, at least one tether attached to at least one end of said segments, a deployment device which, when activated, enables said segments to deploy radially outwardly into a pattern controlled at least in part by said at least one tether.

2. The projectile as defined in claim 1 wherein each segment has a front end and a rear end and wherein said at least one tether connects said rear ends of said segments together.

3. The projectile as defined in claim 2 wherein said pattern comprises said segments arranged as radially extending spokes.

4. The projectile as defined in claim 3 and comprising a restraint extending between and secured to said front end of each adjacent pair of segments.

5. The projectile as defined in claim 3 wherein said segments are substantially circumferentially equidistantly spaced from each other.

6. The projectile as defined in claim 1 wherein each segment has a front end and a rear end and wherein said at least one tether alternatively connects the front ends and rear ends of adjacent segments together.

7. The projectile as defined in claim 1 wherein each segment has a front end and a rear end and wherein said at least one tether connects said front end of each segment to said rear end of its adjacent segment.

8. The projectile as defined in claim 7 wherein said pattern is in the form of a loop.

9. The projectile as defined in claim 1 and comprising a windscreen attached to a forward end of said body.

10. The projectile as defined in claim 9 wherein said windscreen is in the shape of a nose cone.

11. The projectile as defined in claim 9 wherein said deployment device is contained in said windscreen.

12. The projectile as defined in claim 11 wherein said deployment device, when activated, detaches said windscreen from said body.

13. The projectile as defined in claim 1 wherein said segments are encased in a lighter weight material.

14. The projectile as defined in claim 1 wherein each segment has a front end and the front end comprises an aerodynamic reaction surface.

15. The projectile as defined in claim 14 wherein the aerodynamic reaction surface causes the segment to radially separate outwardly from the other segments during flight.

16. The projectile as defined in claim 15 further comprising a windshield that holds the segments together.

17. The projectile as defined in claim 1 wherein plurality of elongated and circumferentially spaced segments are designed to create a man-sized opening in a concrete wall.

18. A projectile comprising:

an elongated body, said body comprising a plurality of elongated and circumferentially spaced segments wherein each of said segments comprises an aerodynamic surface at one end of each of said segments, at least one tether attached to at least one end of at least two segments, and a deployment device which, when activated, enables said segments to deploy radially outwardly into a pattern controlled at least in part by said at least one tether.

19. The projectile as defined in claim 18 wherein the aerodynamic reaction surface causes the segment to radially separate outwardly from the other segments during flight.

20. The projectile as defined in claim 18 wherein said pattern comprises said segments arranged as radially extending spokes.

21. The projectile as defined in claim 18 wherein plurality of elongated and circumferentially spaced segments are designed to create a man-sized opening in a concrete wall.

22. A projectile comprising:

an elongated body, said body comprising a plurality of elongated and circumferentially spaced segments wherein each of said segments comprises an aerodynamic surface at one end of each of said segments and the aerodynamic reaction surface causes the segment to radially separate outwardly from the other segments during flight, at least one tether attached to at least one end of at least two segments, and a deployment device which, when activated, enables said segments to deploy radially outwardly into a pattern controlled at least in part by said at least one tether, and said pattern comprises said segments arranged as radially extending spokes.

23. The projectile as defined in claim 22 wherein plurality of elongated and circumferentially spaced segments are designed to create a man-sized opening in a concrete wall.

* * * * *